US009455076B2

(12) United States Patent
Cascolan

(10) Patent No.: US 9,455,076 B2
(45) Date of Patent: Sep. 27, 2016

(54) COUPLING WITH SOLENOID RELEASE LOCKING MECHANISM

(71) Applicant: Anthony Cascolan, Lombard, IL (US)

(72) Inventor: Anthony Cascolan, Lombard, IL (US)

(73) Assignee: Magnet-Schultz of America, Inc., Westmont, IL (US)

( * ) Notice: Subject to any disclaimer, the term of this patent is extended or adjusted under 35 U.S.C. 154(b) by 0 days.

(21) Appl. No.: 14/592,511

(22) Filed: Jan. 8, 2015

(65) Prior Publication Data

US 2015/0243426 A1 Aug. 27, 2015

Related U.S. Application Data

(60) Provisional application No. 61/942,882, filed on Feb. 21, 2014.

(51) Int. Cl.
*H01F 7/124* (2006.01)
*H01F 7/16* (2006.01)

(52) U.S. Cl.
CPC ..... *H01F 7/124* (2013.01); *H01F 7/1607* (2013.01)

(58) Field of Classification Search
CPC .. H01F 7/1607; H01F 7/124; E05B 47/0002; E05B 47/0603; E05B 47/0004; E05B 2047/0007; E05B 63/121; F42B 10/14; F42B 10/64; F01L 2820/031
See application file for complete search history.

(56) References Cited

U.S. PATENT DOCUMENTS 2,370,027 A 2/1945 Freed
3,245,423 A 4/1966 Hansen et al.
3,549,917 A * 12/1970 Weyer ..... H01F 7/124 310/14
3,753,316 A * 8/1973 Savarieau ..... E05B 47/0603 292/144
3,893,053 A * 7/1975 Onatsevich ..... H01F 7/124 335/165
3,942,828 A * 3/1976 Bourrie ..... E05B 17/2011 292/201
4,078,709 A * 3/1978 Jenkins ..... G11B 15/29 226/180
4,198,080 A 4/1980 Carpenter
4,947,968 A 8/1990 Slavin et al.
5,103,771 A 4/1992 Lee
5,494,323 A 2/1996 Huang
5,540,250 A 7/1996 Mullins
5,829,280 A 11/1998 Chen
6,415,476 B1 * 7/2002 McCoy ..... E05B 15/10 16/224
7,125,058 B2 10/2006 Hawthorne
8,347,974 B2 1/2013 Calvert et al.

(Continued)

FOREIGN PATENT DOCUMENTS

GB 2444933 A * 6/2008 ..... D06F 37/42

*Primary Examiner* — Mohamad Musleh
(74) *Attorney, Agent, or Firm* — Knechtel, Demeur & Samlan

(57) ABSTRACT

A solenoid locking mechanism connects a solenoid body to a male coupling member. The male coupling member surrounds a housing at the end of the solenoid. A pair of ball bearings is retained in the housing and extends into the coupling member. Movement of the ball bearings by the plunger control locking or releasing the coupling member. In an alternate embodiment the solenoid locking mechanism secures the coupling mechanism to a lockable rod that has a ball nose at one end. The locking mechanism has a locking chamber or socket with a ball bearing mounted in the chamber wall. The ball bearing is moveable between a position in which it extends into the locking chamber or can be moved out from the locking chamber. The movement of the ball bearing is controlled by a plunger in the solenoid body. The ball nose is selectively locked in the locking chamber or released from the locking chamber depending on the position of the plunger which controls the position and movement of the ball bearing.

4 Claims, 7 Drawing Sheets

(56) References Cited

U.S. PATENT DOCUMENTS

| | | | |
|---|---|---|---|
| 2004/0061339 | A1 | 4/2004 | Lemettinen |
| 2010/0171332 | A1 | 7/2010 | Geary et al. |
| 2010/0237637 | A1 | 9/2010 | Camp |
| 2012/0175902 | A1 | 7/2012 | Geary et al. |
| 2013/0307280 | A1 | 11/2013 | Camp |

* cited by examiner

COUPLING WITH SOLENOID RELEASE LOCKING MECHANISM

CROSS-REFERENCE TO RELATED APPLICATION

This application is based on and claims priority of provisional patent application 61/942,882 filed Feb. 21, 2014.

BACKGROUND AND SUMMARY OF THE INVENTION

This invention relates to mechanical couplings generally used to connect one apparatus or device to another. In particular it is directed to a quick release ball detent mechanical coupling that uses an electric solenoid to release the locked coupling.

In specific applications, it is desirable to connect a piece of equipment to a stationary object with a releasable coupling. In the past, mechanical couplings used to connect a device in place, such as a grill top, relied on strictly manually operated mechanical locking mechanisms to lock and unlock the device to the coupling. These worked fairly well hut have several shortcomings. First, to unlock the coupling the user has to physically unlatch the locking mechanism. This may be difficult for the user, especially if the user suffers from some form of disability that makes it difficult to manipulate or operate the release mechanism. Furthermore, the location of the coupling may be difficult to reach. Also, the coupling cannot be remotely unlatched by means of a wired or wireless switch. Latch assemblies or blocking device as illustrated in the prior art create more mounting or space constraint issues due to their profile or package size configurations. An electromagnet in a similar small package size may not have enough holding power to be effective in the given application, in addition, it is more difficult to design an enclosure or protective cover around a latch type assembly, blocking device or electromagnet which would be required to prevent contamination from entering the latch assembly.

Applicant's invention overcomes the problems associated with the mechanical couplings of the prior art. An electrically operated solenoid operates a plunger that keeps the latching mechanism either in the locked position of allows the latching mechanism to move to the unlocked position to allow the coupling to release the device.

The invention has a ball detent mechanism that provides a locking and unlocking feature when coupled with the mating receptacle. A solenoid electrically actuates the latch/unlatch ball detent mechanism. Depending on the design, by energizing or de-energizing the solenoid, the ball detent mechanism either locks or unlocks the coupling from the mating receptacle. A mechanical override feature is provided to operate the ball detent mechanism in the event of a solenoid failure.

In an alternate embodiment the solenoid locking mechanism secures a lockable rod to the solenoid locking mechanism. A plunger operated by the solenoid locks or releases several ball bearings from a passageway through which the lockable rod must pass to a locking chamber or socket. Depending on the configuration of locking flats and recesses on the plunger, the ball bearings can be oriented to allow the lockable rod to enter the locking chamber or socket or be restricted from entering. The configuration also allows the ball bearings to lock the lockable rod in the locking chamber or socket when desired.

DESCRIPTION OF THE PREFERRED EMBODIMENT

Figure 1:
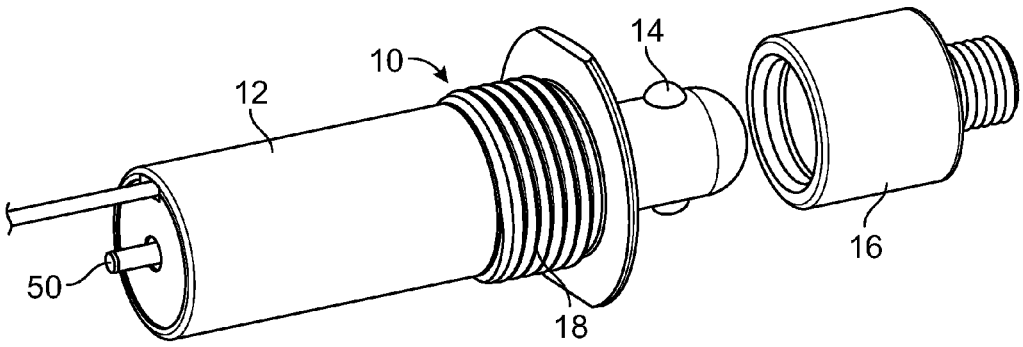
FIG. 1 is a perspective view of the first embodiment of the inventive solenoid coupling removed from the mating receptacle.
Figure 2:
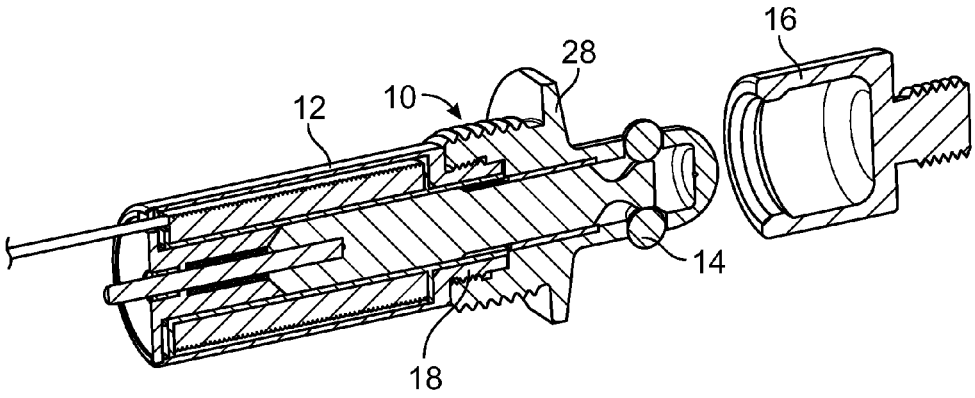
FIG. 2 is a cross sectional view taken longitudinally along the solenoid coupling and mating receptacle.

Turning first to FIGS. 1 and 2, there is illustrated a first embodiment of a solenoid latching mechanism 10 of the present invention. There is an electrically operated solenoid 12 operating a ball detent mechanism 14. The ball detent mechanism 14 fits into a mating receptacle 16 that is connected to a tube or conduit or similar apparatus. The threaded front end 18 of the solenoid 12 is used for mounting the solenoid latching mechanism 10 by means of a hex nut 19 and lock washer 21.

Figure 3:
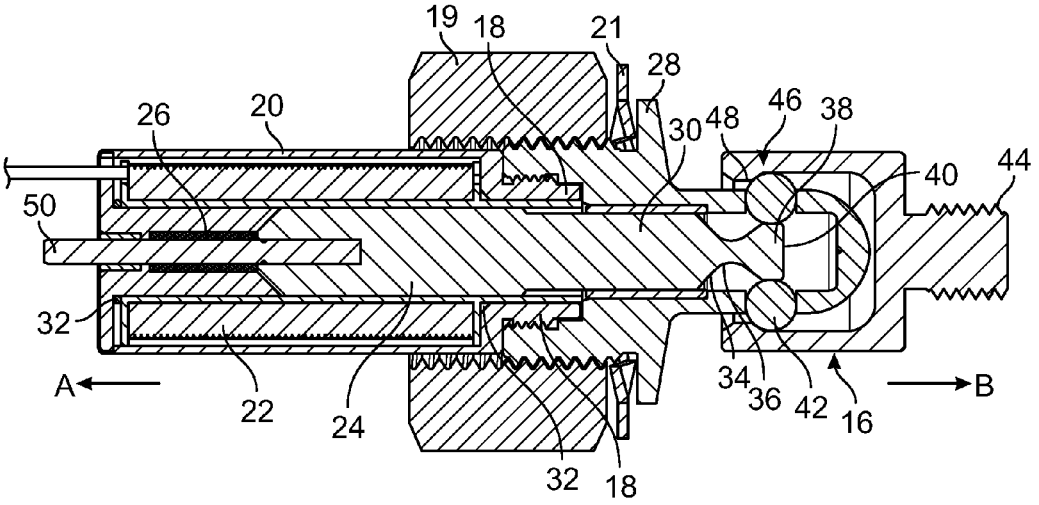
FIG. 3 is a cross sectional view taken longitudinally across the solenoid coupling and mating receptacle in the energized or locked position.

FIG. 3 illustrates the mechanism 10 in the locked position. The solenoid 12 comprises a solenoid body or housing 20, a coil 22, and a plunger or operating arm 24. With power applied to the solenoid 12, the plunger moves in the direction of arrow "A" against the force exerted by spring 26. A housing 28 is screwed onto the threaded front end 18 and secured by the hex nut 19 and lock washer 21. The housing 28 is in axial alignment with the solenoid body 20. The plunger 24 has a plunger tip 30. In this embodiment the plunger 24 and plunger tip 30 are illustrated as a singular piece. However, this can be configures as two pieces with one end of the plunger 24 screwed into the end of the plunger tip 30. When two pieces are used and attached to each other, the plunger 24 and plunger tip 30 can move axially as one piece within the solenoid body 20 and housing 28. The plunger 24 has o-rings 32 disposed around its circumference to seal out contaminants. The plunger tip 30 has a tapered shoulder 34 that drops to a depression 36 and then rises to a head 38 with a plateau top 40. The housing 28 retains at least a pair of ball bearings 42, but more than two can be used.

The mating receptacle 16 has a threaded end 44 and a coupling end 46. At the internal portion of the coupling end 46 is an internal collar 48. In the position illustrated in FIG. 3, the coupling is illustrated in the energized and locked position. This is due to the plunger being pulled by the solenoid in the direction of arrow "A", which draws the plunger tip 30 in this same direction "A". The head 30 and the plateau top 40 force the ball bearings 42 outward from the longitudinal axis of the plunger tip 30 where they will remain until power to the solenoid is removed. With the ball bearings 42 in this position, the coupling end 46 and internal collar 48 cannot move in the direction of arrow "B" and the housing 28 is locked to the mating receptacle 16.

Figure 4:
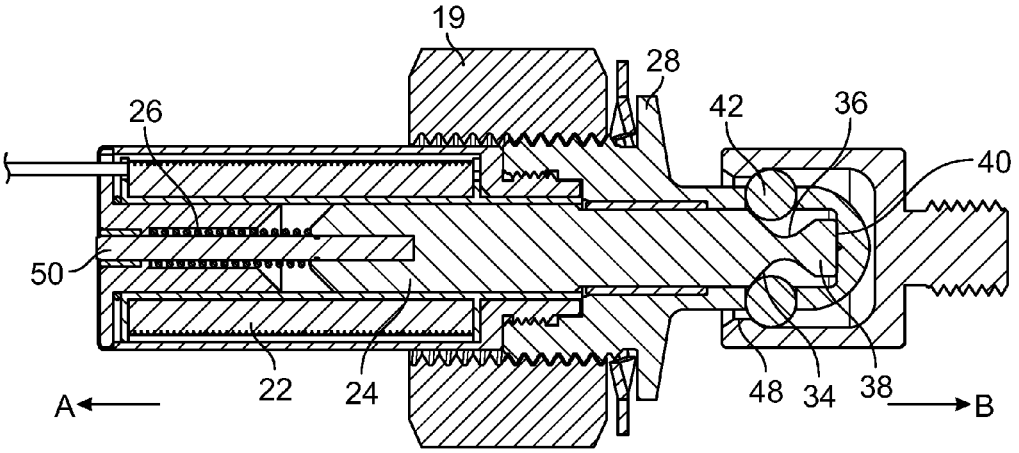
FIG. 4 is a cross sectional view taken longitudinally across the solenoid coupling and mating receptacle in the de-energized or unlocked position.

FIG. 4 illustrates the coupling mechanism 10 when in the de-energized or unlocked position. With no power being supplied to the solenoid coil 22, the plunger 24 is free to move in the direction of arrow "A". However, the spring 26 pushes the plunger 26 in the direction, of arrow "B". This initially causes the ball bearings 42 to move inward toward, the depression 36 and then ride up the tapered shoulder 34 to push the ball bearings 42 outward, from the longitudinal axis of the plunger tip 30. The ball bearings 42 apply a force against the internal collar 48 proportional to the force applied by the spring 26. By manually pulling on the mating receptacle 16 in the direction of arrow "B", the collar 48 will, force the ball bearings 42 down, along the tapered shoulder 34 and into the depression 36. This releases the collar 48 from the ball bearings 42 and allows the mating receptacle 16 to be removed from the housing 28.

Figure 5:
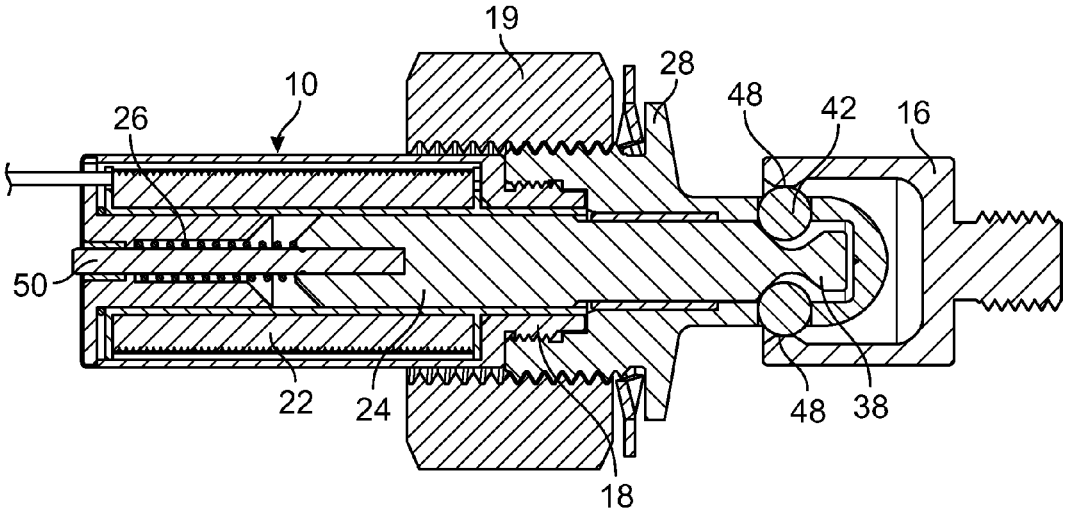
FIG. 5 is a cross sectional view taken longitudinally across the solenoid coupling and mating receptacle in the de-energized to override position.

FIG. 5 illustrates the coupling mechanism 10 in the de-energized to override position, in this position the solenoid 12 is not energized and the plunger 24 is not attracted to the pole piece in the direction of arrow "A". The plunger 24 and plunger tip 30 stay in the extended position due to the force exerted by the spring 26 as seen in FIG. 5. In this override position, the profile of the tapered shoulder 34 will cause the ball bearings 42 to move outward, but will not block the internal collar 48 from releasing the mating receptacle 16. In this position, the ball bearings 42 remain in the outward position and provide a sealing feature to keep contaminants away from the interior of the housing 28. If the solenoid should jam or become inoperative, the Manual override pin 50 can be pushed in to unlock the mating receptacle 16.

An alternate embodiment of a solenoid latching mechanism 54 is illustrated in FIGS. 6-9. The solenoid latching mechanism 54 has a solenoid body 56 with a solenoid coil 58 that is energized through an electrical wire 59. The coil 58 is separated from the solenoid body 56 by a coil winding gap 60. Centrally disposed within the body 56 is a sleeve 62, preferably made from stainless steel. The sleeve 62 has a tapered or cone shaped opening 64 at one end of the sleeve. The tapered opening 64 channels down into a cylindrical locking chamber or socket 66. The latching mechanism 54 can be mounted by means of a hex nut and washer such as illustrated in FIGS. 1 and 2 but not illustrated for clarity in FIG. 6.

Figure 6:
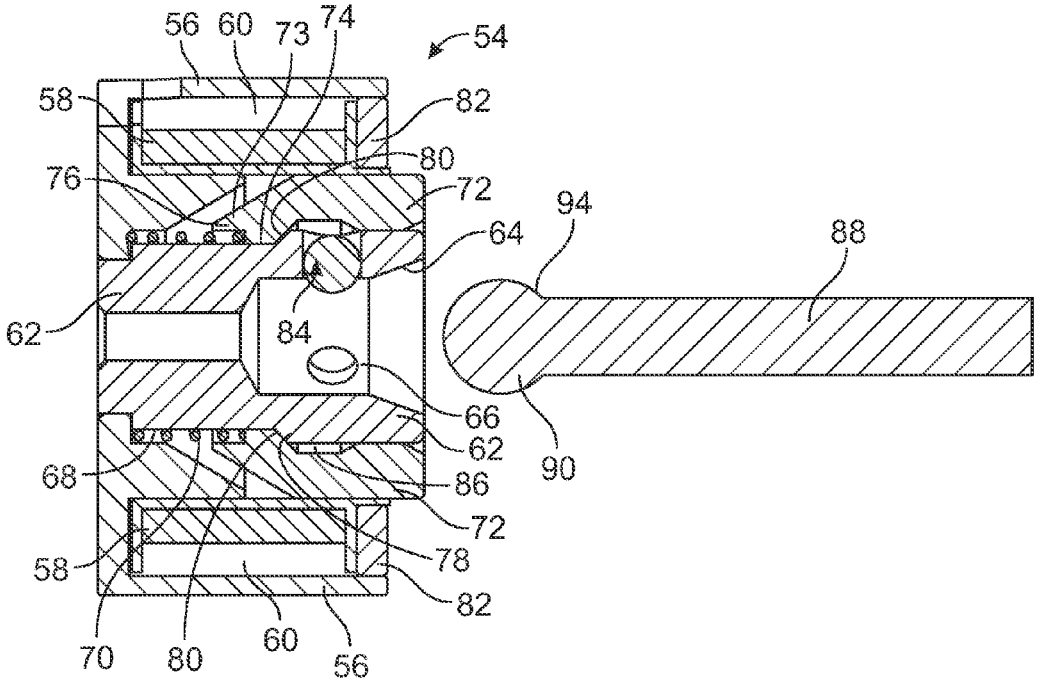
FIG. 6 is a cross sectional view of an alternate embodiment taken longitudinally across the solenoid coupling and mating lockable rod in the unlocked position with the lockable rod removed from the solenoid coupling mechanism.

Opposite the tapered opening 64, the sleeve 62 has a groove 68 cut around its circumference. Disposed around the groove 68 is a compression spring 70. Mounted around the sleeve 62 is a plunger 72 which is held captive within the solenoid body 56. The plunger 72 is cylindrical and is mounted in the solenoid body 56 so that the central opening of the plunger encompasses the sleeve 62 and opening 64. As seen in FIG. 6, the plunger has a leading edge 73, a foot 74 and an extending finger 76. The finger 76 aids in retaining the spring 70 in a captive position around the sleeve 62. The plunger 72 is securely mounted in the solenoid body 56 by means of a stationary stepped portion 78 on the sleeve 62 which engages a tapered portion 80 on the plunder 72. The plunger 72 is free to slide longitudinally along the groove 68 between the stepped portion 78 to the point where the leading edge of the plunger 73 engages the wall of the sleeve 62.

In the first alternative embodiment there are steel washers 82 surrounding the plunger 72. The washers 82 are securely mounted in the solenoid body 56. In a second alternative embodiment the steel washers are replaced with radially magnetized magnets. The difference in operation of the latching mechanism will be described below.

Mounted within the sleeve 62 and surrounding the locking chamber or socket 66 is a plurality of hardened stainless steel ball bearings 84. Preferably there should be at least three bearings 84 but more may be used. There is a recess 86 on the inner wall of the plunger 72 which receives the ball bearings 84 at certain times during the latching or releasing process.

The latching mechanism 54 is adapted to receive a hardened steel lockable rod 88 in locking engagement so that the lockable rod is locked to the solenoid body 56 or selectively released therefrom. The steel lockable rod can be part of any one of numerous devices that are to be coupled to another device by means of the latching mechanism 54. The lockable rod 88 has a leading ball nose 90 which is the portion that is received. In locking engagement with the locking mechanism 54 as will be described below.

Figure 7:
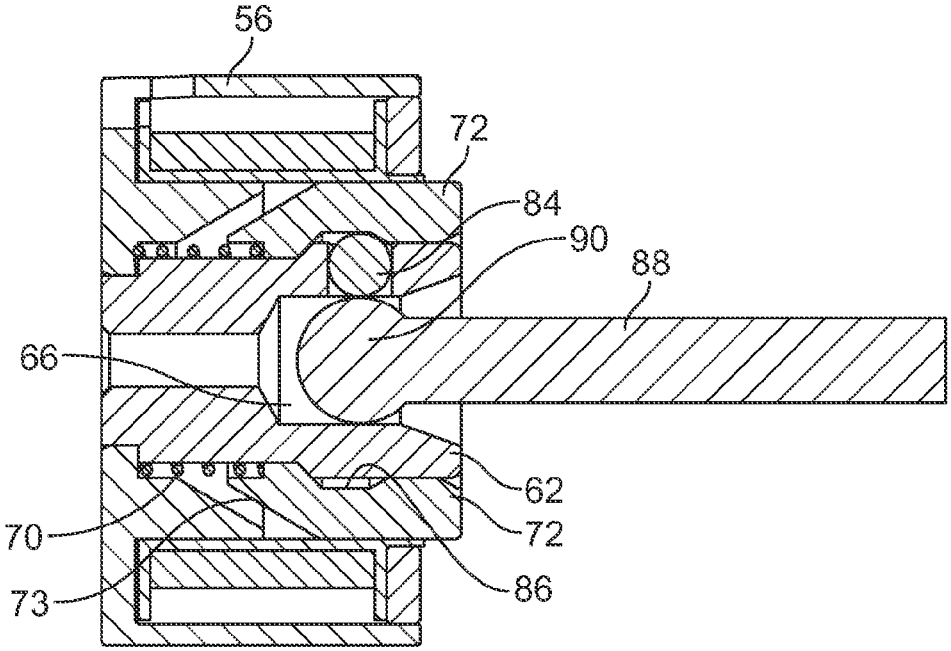
FIG. 7 is a cross sectional view of the alternate embodiment taken longitudinally across the solenoid coupling and mating lockable rod in the unlocked position with the lockable rod partially inserted into the solenoid coupling mechanism.
Figure 8:
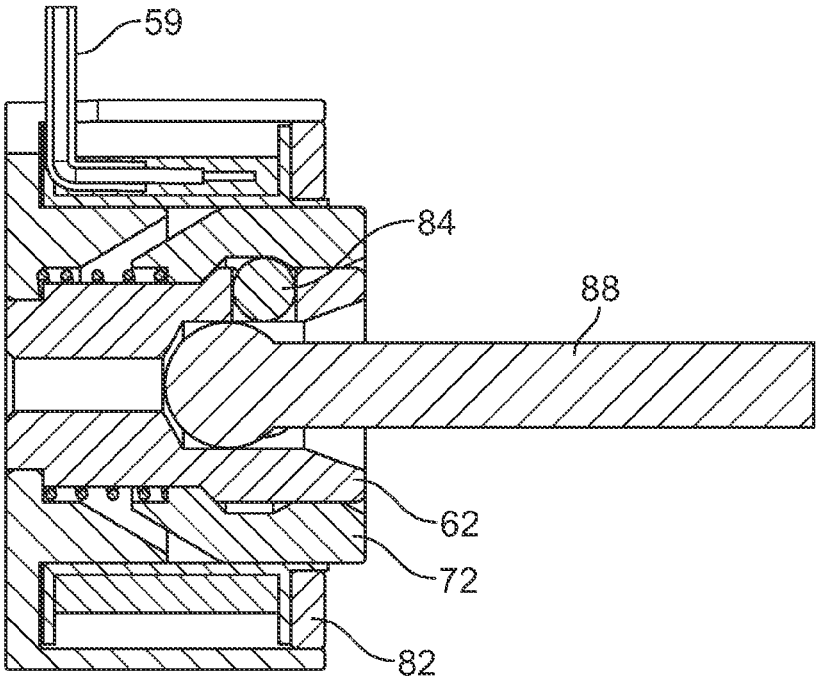
FIG. 8 is a cross sectional view of the alternate embodiment taken longitudinally across the solenoid coupling and mating lockable rod in the unlocked position with the lockable rod fully inserted into the solenoid coupling mechanism.
Figure 9:
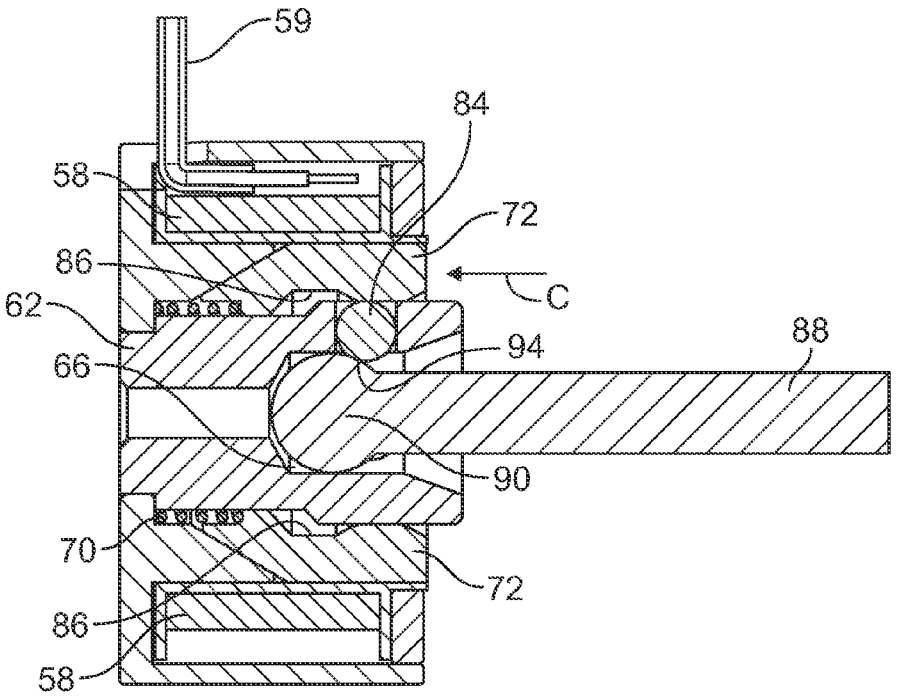
FIG. 9 is a cross sectional view of the alternate embodiment taken longitudinally across the solenoid coupling and mating lockable rod in the energized and locked position with the lockable rod fully inserted into the solenoid coupling mechanism.

The operation of the latching mechanism 54 will now be described. FIG. 6 illustrates the unlocked position with the steel lockable rod 88 out of the latching mechanism 54. In the first alternate embodiment wherein there are steel washers 82, the lockable rod 88 is pushed into the tapered opening 64. The tapered walls of the opening 64 assist in guiding the ball nose 90 into the opening 64 and allows for some misalignment. As seen in FIG. 7, the ball nose 90 pushes the ball bearings 84 into the recess 86 in the plunger 72. The depth of the recess 86 is sufficient to receive the ball bearings so that the ball nose 90 can travel past the ball bearings 84 and be fully received in the locking chamber or socket 66 as seen in FIG. 8. At this point the ball nose 90 is fully inserted into the locking chamber or socket 66 but is not locked therein and can be pulled back out of the latching mechanism 54. Power is then applied to the solenoid coil 58 which pulls the plunger 72 in the direction of arrow "C" as seen in FIG. 9. A locking flat 92 on plunger 72 pushes the ball bearing 84 down against a trailing edge 94 of the ball nose 90 which locks the ball nose 90 within the locking chamber or socket 66. As long as the solenoid coil 58 remains energized, the ball nose 90 remains locked in the locking chamber or socket 66. When power is removed from the solenoid coil 58, the lockable rod 88 can be removed. This provides a coupling that has a fail safe mode in the unlock position.

In FIGS. 10-13 there is illustrated a second alternate embodiment of the solenoid latching mechanism that operate essentially the same as the first alternate embodiment except utilizes a reconfigured plunger 72. In the second alternate embodiment the leading edge 73, foot 74, extending finger 76, and tapered portion 80 are the same as the first alternate embodiment. However the recess 86 and the locking flat 92 have been reconfigured as will be described below.

Figure 10:
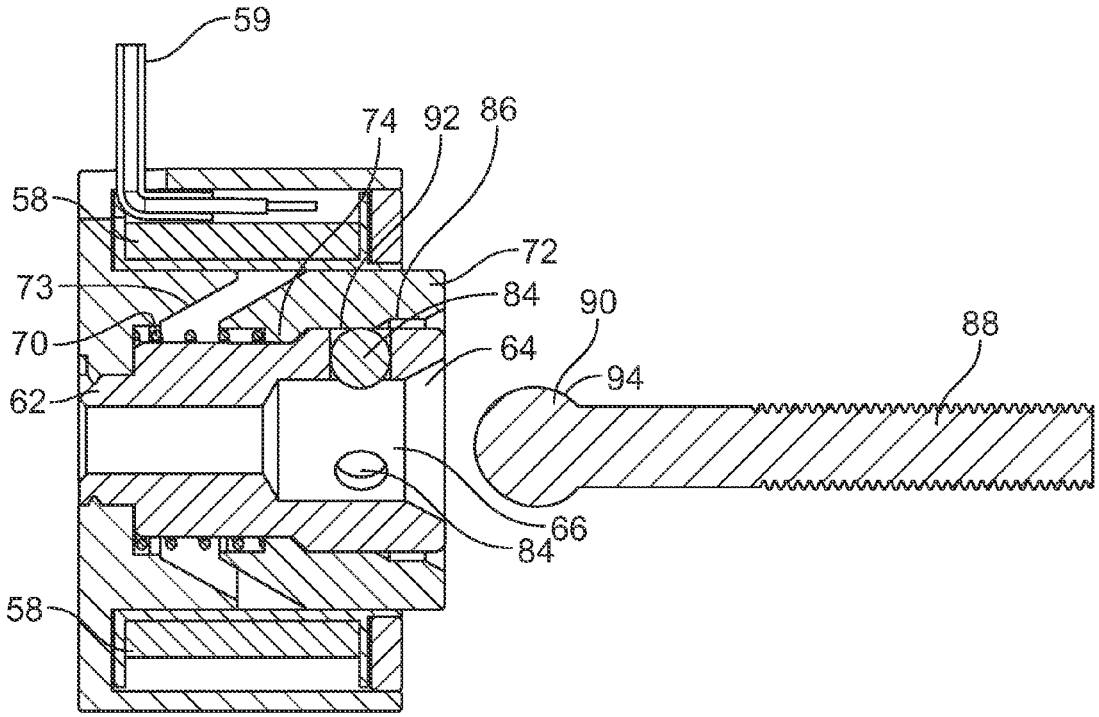
FIG. 10 is a cross sectional view of a second alternate embodiment taken longitudinally across the coupling and mating lockable rod in the de-energized locked position with the lockable rod removed from the solenoid coupling mechanism.
Figure 11:
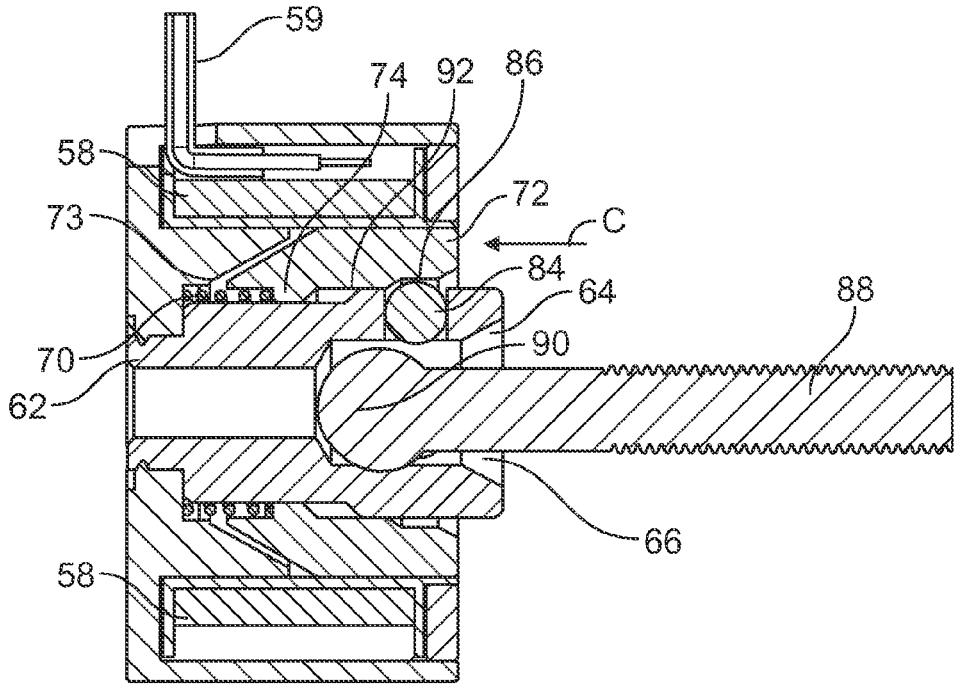
FIG. 11 is a cross sectional view of the second alternate embodiment in the energized to unlock position with the lockable rod tally inserted into the solenoid coupling mechanism.

In FIG. 10 one can see that the plunger 72 has the locking flat 92 moved toward the leading edge 73 with the recess 86 located near the end of the plunger opposite the leading edge 73 and adjacent to the end of the coupling having the tapered opening 64. In FIG. 10 the solenoid 58 is de-energized and the spring 70 pushes the plunger 72 toward the opening 64. The locking flat 92 pushes the ball bearings 84 into the locking chamber or socket 66. This prevents the ball nose 90 from entering into the locking chamber or socket and it is in effect "locked out".

Figure 12:
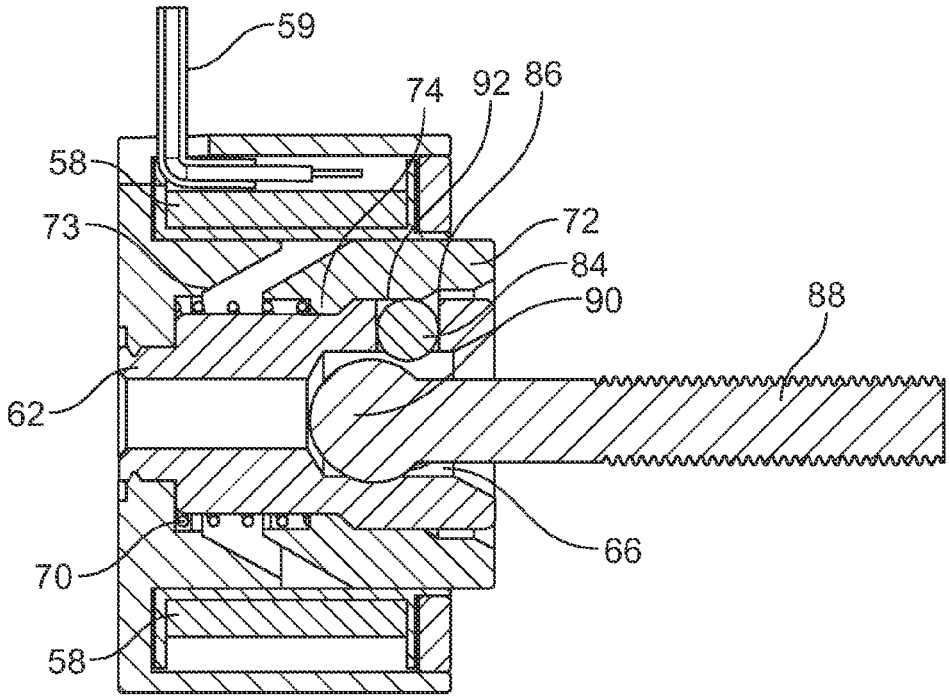
FIG. 12 is a cross sectional view of the second alternate embodiment in the de-energized to lock position with the lockable rod fully inserted into the solenoid coupling mechanism.

When the solenoid coil 58 is energized, the plunger 72 moves in the direction of arrow and the recess 86 in the plunger allows the ball bearings 84 to be pushed outward from the locking chamber or socket 66. This allows the ball nose 90 to go past the ball bearings 90 and fully enter the locking chamber or socket 66. By de-energizing the solenoid coil 58, the spring 70 pushes the plunger 72 so that it moves in the direction opposite of arrow "C" and the ball nose 90 will be locked in the locking chamber or socket 66 such as illustrated in FIG. 12.

Figure 13:
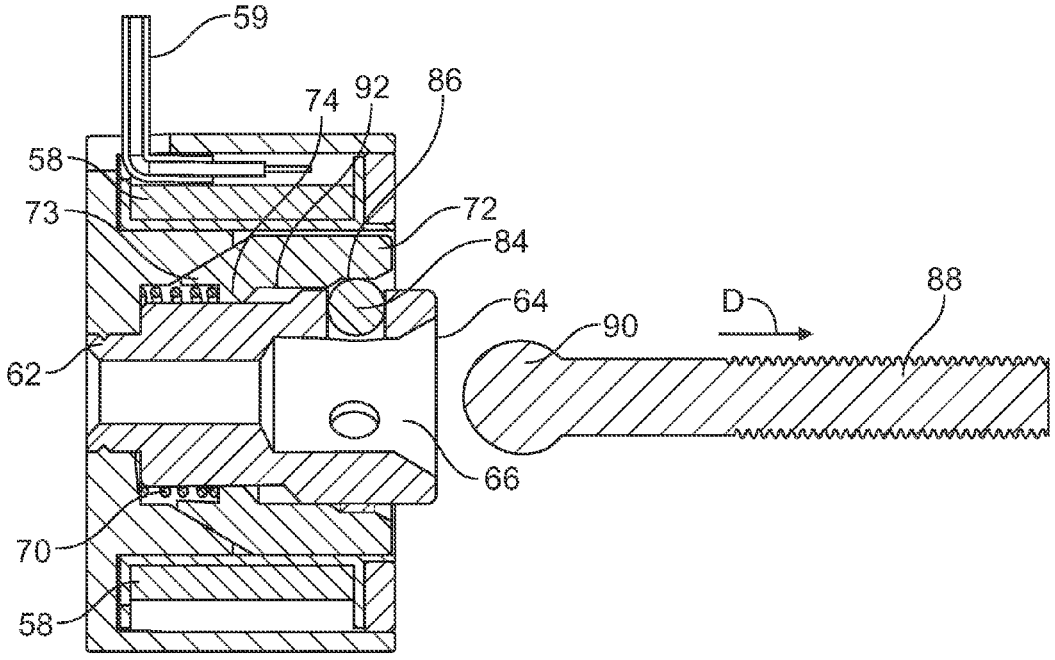
FIG. 13 is a cross sectional view of the second alternate embodiment in the energized to unlock position with the lockable rod removed from the solenoid coupling mechanism.

In FIG. 13 the solenoid coil 58 is again energized which pulls the plunger 72 in the direction of arrow "C" which allows the ball bearings 84 to be pushed into the recess 86 when the lockable rod 88 is pulled backward in the direction of arrow "D". The ball nose 90 is thus allowed to be withdrawn from the locking chamber or socket 66 and withdrawn, from the locking mechanism.

The second alternate embodiment illustrated in FIGS. 10-13 has the solenoid coil 58 configured to energize the coil to unlock the lockable rod 88 and de-energize the coil to lock the lockable rod 88. However, it should be noted that the solenoid 56 and plunger 72 can be designed with multiple internal configurations to provide different means for operating the solenoid and plunger mechanically and electrically. For example the solenoid coil 58 can be energized to either lock or unlock the solenoid can be de-energized to either lock or unlock. The solenoid can be configured for fail-safe operation in which a latching solenoid is used with the latching solenoid will remain unlocked when no power is applied to the solenoid, or fail-secure operation in which the latching solenoid will remain locked when no power is applied to the latching solenoid. This can be configured by either using a pull or push type solenoid and a latching solenoid as is known to those skilled in the art.

Any number of combinations can be built by properly configuring the recess in the plunger to coordinate and operate in conjunction with energizing or de-energizing the solenoid coil 58 or, as stated above, using a latching solenoid. Also, the steel washers 82 can be replaced with radially magnetized magnets. This allows other variations of operation, of the solenoid latching mechanism. For example when the steel washer 82 is replaced with a permanent magnet which is radially magnetized, the solenoid 56 will hold the plunger 72 in place without the need to continuously supply electrical energy to the coil 58. This embodiment that embeds a permanent, magnet will produce a desired fail-safe holding force and also provide an additional energy savings benefit. The design requires that only a short pulse of electrical energy be applied to the coil 58 to affect pull-in or the release function of the plunger 72.

To attract and then hold the plunger 72 toward the solenoid 56, the polarity of the actuation pulse to the coil must be in synchronization with the permanent magnet. Once the plunger 72 is seated with the solenoid 56, the permanent magnet will securely hold the plunger 72 in place. To release the plunger 72 from the solenoid 56, an even shorter electrical pulse of opposite polarity to the permanent magnet is all that is required to nullify the magnet's hold and will release the plunger 72 away from the solenoid 56 with the aid of the spring 70. In either the pulled-in or the released state, the permanent magnet and spring combination requires "zero" continuous energy to remain in that state.

The inventive coupling with solenoid release locking mechanism is a great advantage over prior art ball detent locking mechanisms that relied on strictly manual mechanical means to release the coupling. By increasing the number of ball bearings in the housing, the force necessary to lock and unlock the housing from the mating lockable rod can be adjusted and varied.

Thus there has been provided a solenoid coupling that fully satisfies the objects set forth above. While the invention, has been described in conjunction with specific embodiments, it is evident that many alternatives, modifications and variations will be apparent to those skilled in the art in light of the foregoing description. Accordingly, it is intended to embrace all such alternatives, modifications and variations as fall within, the spirit and scope of the appended claims.

What is claimed is:

1. A solenoid operated coupling mechanism comprising:

a solenoid body, a solenoid coil mounted in the solenoid body, a plunger mounted in the solenoid body and adapted for movement between a first retracted locked position and a second extended unlocked position in response to energizing and de-energizing the solenoid coil, the plunger having opposite ends with one end being a rear end and the other being a forward operating end extending out from the solenoid body, a spring mounted in the solenoid body and engaging the rear end of the plunger for pushing the plunger in a forward direction, the forward operating end having an enlarged head and a groove disposed behind the enlarged head, the groove having opposite angulated sidewalls tapering inward toward a bottom of the groove, one of the sidewalls being a forward sidewall and the other being a rearward sidewall, a housing having one end surrounding the operating end of the plunger with a passageway in the housing for receiving the operating end of the plunger, and an end wall disposed at an opposite end of the housing, a pair of ball bearings mounted in an aperture on the housing, a mating receptacle adapted for mounting on the housing, the mating receptacle having a locking collar for engaging the ball bearings on the housing for locking and unlocking the mating receptacle from the housing depending on whether the plunger is in the first retracted position or the second extended position, the spring drawing the plunger rearward to the first retracted locked position when the solenoid is de-energized with the head engaging the ball bearings forcing the ball bearings outward into the aperture where they engage the locking collar thereby locking the receptacle onto the housing, the solenoid pushing the plunger forward to the extended unlocked position when the solenoid is energized allowing the ball bearings to move into the groove and allowing the locking collar to pass over the ball bearings and the receptacle to be removed from the housing, the plunger moving the head against the end wall with the rearward sidewall engaging the ball bearing and applying a force to the ball bearing for keeping the ball bearings partially in the aperture to engage the locking collar and hold the receptacle in place on the housing until a retraction force is applied to the receptacle which applies a force against the ball bearings which pushes the ball bearings against the rearward sidewall of the groove with sufficient force against the plunger to overcome the solenoid force thereby pushing the plunger rearward allowing the ball bearings to move into the groove and the locking collar to pass over the ball bearings thereby releasing the collar.

2. A solenoid operated coupling mechanism comprising:

a solenoid body, a solenoid coil mounted in the solenoid body, a plunger mounted in the solenoid body and adapted for movement between a first retracted locked position and a second extended unlocked position in response to energizing and de-energizing the solenoid coil, the plunger having opposite ends with one end being a rear end and the other being a forward operating end extending out from the solenoid body, a spring mounted in the solenoid body and engaging the rear end of the plunger for pushing the plunger in a forward direction, the forward operating end having an enlarged head and a groove disposed behind the enlarged head, the groove having opposite angulated sidewalls tapering inward toward a bottom of the groove, one of the sidewalls being a forward sidewall and the other being a rearward sidewall, a housing having one end surrounding the operating end of the plunger with a passageway in the housing for receiving the operating end of the plunger, and an end wall disposed at an opposite end of the housing, a pair of ball bearings mounted in an aperture on the housing, a mating receptacle adapted for mounting on the housing, the mating receptacle having a locking collar for engaging the ball bearings on the housing for locking and unlocking the mating receptacle from the housing depending on whether the plunger is in the first retracted position or the second extended position, the solenoid drawing the plunger rearward to the first retracted locked position when the solenoid is energized with the head engaging the ball bearings forcing the ball bearings outward into the aperture where they engage the locking collar thereby locking the receptacle onto the housing, the spring pushing the plunger forward to the extended unlocked position when the solenoid is de-energized allowing the ball bearings to move into the groove and allowing the locking collar to pass over the ball bearings and the receptacle to be removed from the housing, the plunger moving the head against the end wall with the rearward sidewall engaging the ball bearing and applying a force to the ball bearing for keeping the ball bearings partially in the aperture to engage the locking collar and hold the receptacle in place on the housing until a retraction force is applied to the receptacle which applies a force against the ball bearings which pushes the ball bearings against the rearward sidewall of the groove with sufficient force against the plunger to overcome the spring force thereby pushing the plunger rearward allowing the ball bearings to move into the groove and the locking collar to pass over the ball bearings thereby releasing the collar.

3. The solenoid operated coupling mechanism of claim 2 wherein the mating receptacle is substantially cylindrical and the locking collar extends radially from an interior wall of the mating receptacle.

4. The solenoid operated coupling of claim 2 wherein the spring engages the solenoid operated plunger and for selectively moving the plunger between the first and second positions in cooperation with energizing and de-energizing the solenoid coil.

* * * * *